US007794305B2

(12) United States Patent
Nelson

(10) Patent No.: US 7,794,305 B2
(45) Date of Patent: Sep. 14, 2010

(54) ELECTRIC PORTABLE GRINDER WITH AIR COOLING SYSTEM

(75) Inventor: Anders Urban Nelson, Älvsjö (SE)

(73) Assignee: Atlas Copco Tools AB, Nacka (SE)

( * ) Notice: Subject to any disclaimer, the term of this patent is extended or adjusted under 35 U.S.C. 154(b) by 91 days.

(21) Appl. No.: 12/086,067

(22) PCT Filed: Nov. 22, 2006

(86) PCT No.: PCT/SE2006/001325

§ 371 (c)(1),
(2), (4) Date: Jun. 5, 2008

(87) PCT Pub. No.: WO2007/067117

PCT Pub. Date: Jun. 14, 2007

(65) Prior Publication Data

US 2009/0280731 A1 Nov. 12, 2009

(30) Foreign Application Priority Data

Dec. 7, 2005 (SE) ..... 0502675

(51) Int. Cl.
*B24B 49/00* (2006.01)

(52) U.S. Cl. ..... 451/7; 451/342

(58) Field of Classification Search ..... 451/7, 451/456, 8, 342
See application file for complete search history.

(56) References Cited

U.S. PATENT DOCUMENTS

| | | | | |
|---|---|---|---|---|
| 4,422,239 | A * | 12/1983 | Maier et al. | 451/456 |
| 4,671,020 | A * | 6/1987 | Hutchins | 451/357 |
| 4,839,995 | A * | 6/1989 | Hutchins | 451/357 |
| 5,218,790 | A * | 6/1993 | Huang | 451/359 |
| 5,964,645 | A * | 10/1999 | Jemt | 451/41 |
| 6,848,985 | B2 | 2/2005 | Lamprecht et al. | |
| 7,282,074 | B1 * | 10/2007 | Witter | 451/453 |

FOREIGN PATENT DOCUMENTS

| | | |
|---|---|---|
| DE | 1 073 606 | 1/1960 |
| EP | 1 658 936 A1 | 5/2006 |
| GB | 315783 | 6/1930 |
| JP | 2000-246672 A | 9/2000 |
| WO | WO 02/34462 A1 | 5/2002 |

* cited by examiner

*Primary Examiner*—Maurina Rachuba
(74) *Attorney, Agent, or Firm*—Frishauf, Holtz, Goodman & Chick, P.C.

(57) ABSTRACT

A portable electric grinder with an air cooling system and connected to a remote stationary voltage supply means (19, 20) via a cable (16), wherein a cooling air duct (21) is provided to connect cooling air passages (23*a, b*) in the grinder housing (10) to a stationary air pumping device, and the air pumping device is provided with a filter unit (24) for preventing dust and other undesirable particles from entering the air duct (21) and reaching the cooling air passages (23*a, b*) of the grinder housing (10).

3 Claims, 2 Drawing Sheets

ELECTRIC PORTABLE GRINDER WITH AIR COOLING SYSTEM

This application is a U.S. National Phase Application under 35 USC 371 of International Application PCT/SE2006/001325 filed Nov. 22, 2006.

FIELD OF THE INVENTION

The invention relates to an electric portable grinder connected to a voltage source connection via a cable and including an air cooling system.

BACKGROUND OF THE INVENTION

A problem concerned with electrically powered portable grinders is to lead away the heat generated during operation so as to protect the electric motor and other components of the grinder from being exposed to detrimentally high temperatures.

The common way to accomplish temperature control in electric grinders and similar power tools is to incorporate in the power tool a fan and suitable air circulation passages in the tool housing for ducting cooling air past the hottest areas of the tool.

A problem inherent in these fan cooled power tools is that they circulate the ambient air at the working site which in many cases is heavily contaminated with dust and debris from the working process. This is a particularly serious problem at grinders, because the ambient air at the working site is always more or less contaminated with aggressive particles. All these air born particles not only cause a clogging up of the air circulation passages in the tool housing with an impaired cooling effect as a result, but act as a blasting means wearing down the material of the tool housing and, even worse, wearing down the windings of the electric motor, thereby causing short circuiting and/or current interruption, i.e. interruption of an ongoing working process. Dust particles entering the tool will also cause a severe wear on the motor and spindle bearings.

Even though fan cooled power tools normally are provided with some sort of filter devices to prevent dust penetration into the tool housing and motor, these filter devices are very limited in size not to cause increased outer dimensions of the tool housing. This means that such a small size filter device has a very small air penetration area resulting in that they get clogged up very quickly and the risk for reduced cooling and motor overheating is great. To avoid this, short service intervals are required for exchange or cleaning of the filter device. Still, dust penetrates into the tool motor and bearings and causes a limited service life of the power tool.

Another problem relating to fan cooled electric power tools is the space demand for the cooling fan. It is in fact undesirable to make room for a cooling fan inside a portable power tool since this type of tools is required to have as small as possible outer dimensions for comfortable handling.

SUMMARY OF THE INVENTION

The main object of the invention is to provide a cable connected electric portable grinder provided with an air cooling system which prevents the grinder from being exposed to a contaminated cooling air flow, but instead improves the cooling effect and extends the service intervals as well as the total service life of the grinder.

Other objects and advantages of the invention will appear from the following specification and claims.

According to one aspect of the present invention, a system includes an electric portable grinder connected to a stationary power supplying drive unit, wherein the grinder comprises a housing, at least one cooling air passage in the housing, and an electric motor. In addition, the system includes a cable connecting the grinder to the drive unit, and an air cooling system including an air pumping device, wherein the air pumping device is associated with the drive unit. The cable includes as integrated parts: (i) a first section containing a set of conductors for supplying electric power to the motor, (ii) a second section containing a set of conductors for communicating electric signals between the grinder and the drive unit, and (iii) a third section forming an air duct that is provided to connect the air pumping device with the at least one cooling air passage, for communicating cooling air from the air pumping device to the at least one air cooling passage.

A preferred embodiment of the invention is described below with reference to the accompanying drawings.

DETAILED DESCRIPTION

Figure 1:
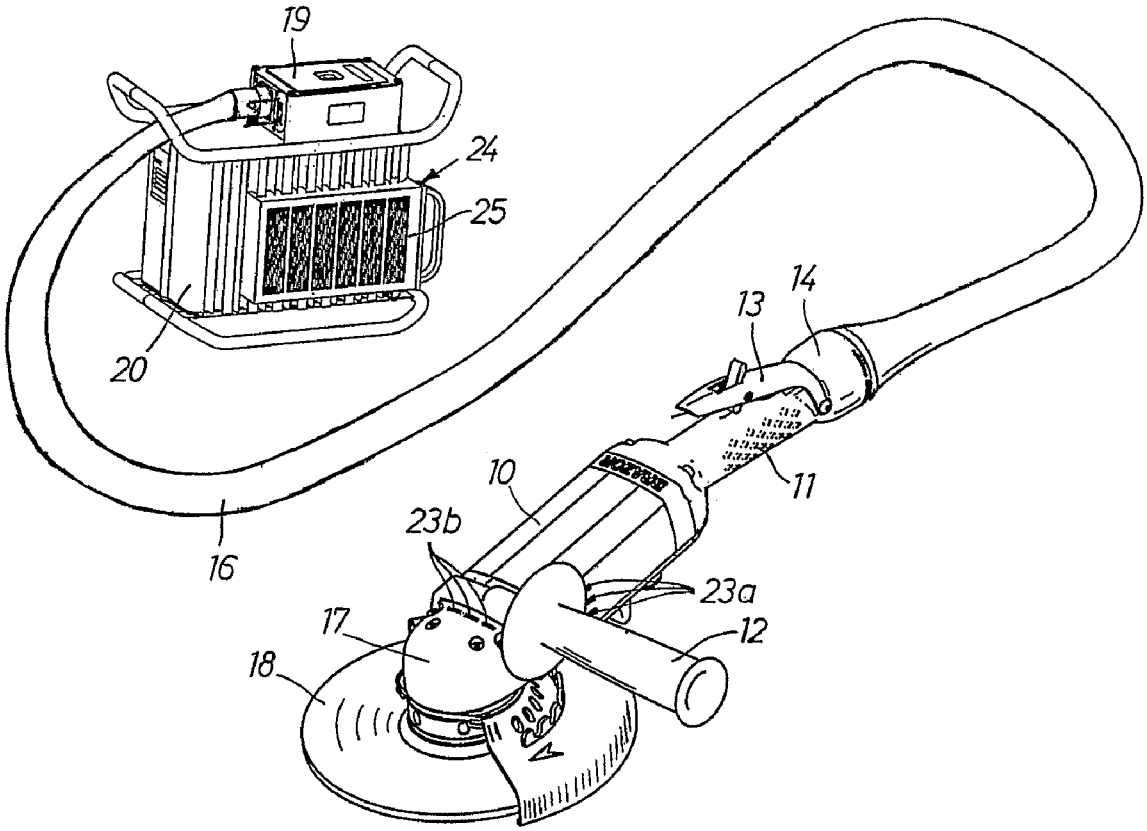
FIG. 1 shows a portable electric grinder according to the invention connected to a combined stationary voltage source and cooling air pumping device.

The electric grinder shown in FIG. 1 comprises a housing 10, a rotation motor (not shown), and two handles 11,12 for manual support and handling of the tool. One of the handles 11 is mounted at the rear end of the housing 10 and comprises a power control lever 13 and a connection device 14 for a power supply cable 16. At its forward end the housing 10 is provided with an angle head 17 in which is rotationally supported an output shaft and a grinding wheel 18 attached thereto.

Figure 2:
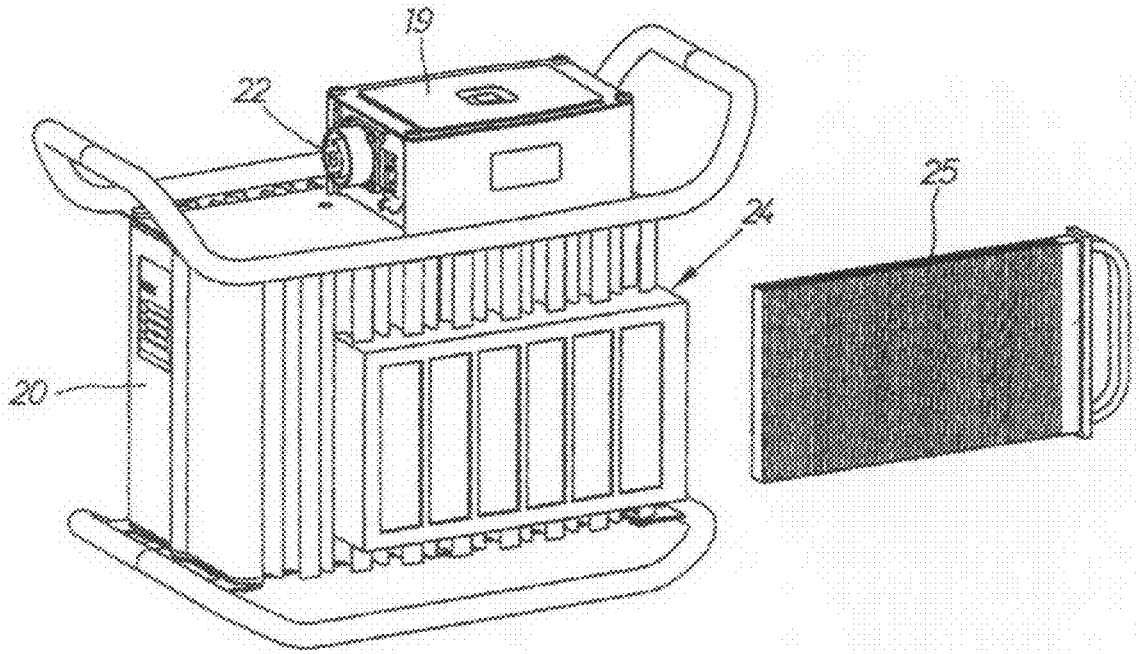
FIG. 2 shows the voltage source and cooling air pumping device with the filter cassette removed.
Figure 3:
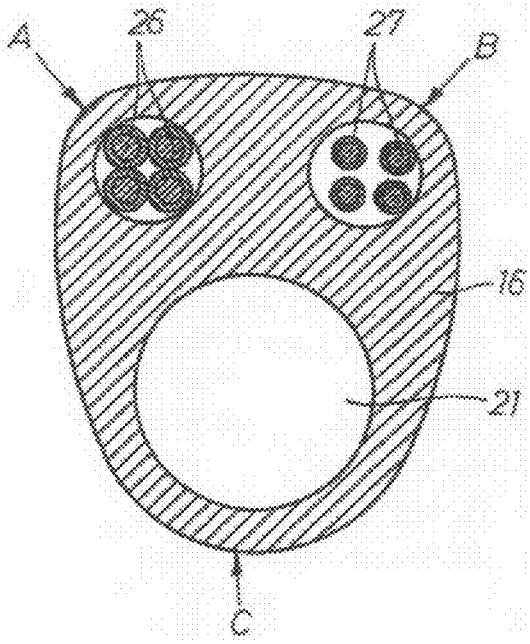
FIG. 3 shows, on a larger scale, a cross section through a combined cable and cooling air duct according to the invention.

The power supply cable 16 extends between the grinder handle 11 and a voltage source connection device 19. The latter is a part of an inverter type drive unit 20 by which the motor is energized with a voltage adaptable to the operation conditions of the tool. The cable 16 also comprises an air duct 21 which communicates cooling air from an air pumping device (not illustrated per se) to air cooling passages 23*a* and 23*b* in and on the grinder housing 10. See FIG. 3. The air pumping device is a part of the motor drive unit 20 and includes an air filter unit 24 for preventing dust and other undesirable particles from entering the air duct 21 and reaching the cooling passages 23*a,b* of the housing 10. This filter unit 24 has a large air penetration area to keep down the flow resistance therethrough during quite a long service interval despite having caught a lot of dust. As illustrated in FIG. 2 the filter unit 24 has the form of a removable cassette 25 for easy cleaning.

The grinder may very well be equipped with one or more operation parameter sensors, for instance a temperature sensor, and the cable 16 comprises both a set of power voltage conductors 26 and a set of signal conductors 27. The power voltage conductors 26 communicate electric power to the motor, whereas the signal conductors 27 communicate electric signals from the operation parameter sensor or sensors to the drive unit 20 for controlling the power supply to the motor as is well known in this type of tools. The cable 16 comprises a first section A containing the power voltage conductors 26, a second section B containing the signal conductors 27 and third section C containing the cooling air duct 21. The connection device 19 on the motor drive unit 20 comprises a number of connectors for the power and signal conductors 26,27 as well as a central air passage 22 for feeding cooling air from the air pumping device to the air duct 21.

In the air cooling system illustrated in the drawings, the air duct 21 is integrated in the cable 16, but there are of course other possibilities to connect the grinder to an air pumping device within the scope of the invention, for instance via a separate air hose running substantially in parallel with the electric cable 16. Further, the air pumping device does not have to be integrated with the motor drive unit 20, but could as well be a separate unit with a connection device located adjacent the cable connection 19.

The invention claimed is:

1. A system comprising:

an electric portable grinder connected to a stationary power supplying drive unit, wherein the grinder comprises a housing, at least one cooling air passage in the housing, and an electric motor;

a cable connecting the grinder to the drive unit; and an air cooling system including an air pumping device, wherein the air pumping device is associated with the drive unit;

wherein the cable comprises as integrated parts: (i) a first section containing a set of conductors for supplying electric power to the motor, (ii) a second section containing a set of conductors for communicating electric signals between the grinder and the drive unit, and (iii) a third section forming an air duct that is provided to connect the air pumping device with the at least one cooling air passage, for communicating cooling air from the air pumping device to the at least one air cooling passage.

2. The system according to claim 1, wherein the air pumping device comprises a filter unit for preventing dust and debris from entering said air cooling system.

3. The system according to claim 2, wherein the filter unit comprises a removable cassette.

* * * * *